US009997289B2

(12) United States Patent
Eguchi et al.

(10) Patent No.: US 9,997,289 B2
(45) Date of Patent: Jun. 12, 2018

(54) MAGNETIC MATERIAL AND DEVICE

(71) Applicant: Kabushiki Kaisha Toshiba, Minato-ku (JP)

(72) Inventors: Tomoko Eguchi, Yokohama (JP); Tomohiro Suetsuna, Kawasaki (JP); Koichi Harada, Bunkyo (JP); Toshihide Takahashi, Yokohama (JP); Seiichi Suenaga, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 241 days.

(21) Appl. No.: 14/842,163

(22) Filed: Sep. 1, 2015

(65) Prior Publication Data

US 2016/0086705 A1 Mar. 24, 2016

(30) Foreign Application Priority Data

Sep. 18, 2014 (JP) ..... 2014-189814

(51) Int. Cl.
*H01F 1/28* (2006.01)
*H01F 1/24* (2006.01)
(Continued)

(52) U.S. Cl.
CPC ..... *H01F 27/255* (2013.01); *H01F 1/28* (2013.01); *H01F 1/37* (2013.01); *H01F 41/0246* (2013.01)

(58) Field of Classification Search
CPC ..... H01F 1/06; H01F 1/24; H01F 1/01; H01F 1/37; H01F 1/28; H01F 1/0063; H01F 1/09; H01F 27/255
(Continued)

(56) References Cited

U.S. PATENT DOCUMENTS 6,048,601 A * 4/2000 Yahagi ..... C22C 33/0278 174/391
8,475,922 B2 * 7/2013 Suetsuna ..... B32B 5/16 252/62.54
(Continued)

FOREIGN PATENT DOCUMENTS

CN 1197988 A 11/1998
CN 1822253 A 8/2006
(Continued)

OTHER PUBLICATIONS

Machine translation of JP2002105502A, printed Jun. 23, 2017, 13 pages.*
(Continued)

*Primary Examiner* — Matthew E Hoban
*Assistant Examiner* — Lynne Edmondson
(74) *Attorney, Agent, or Firm* — Oblon, McClelland, Maier & Neustadt, L.L.P.

(57) ABSTRACT

Provided is a magnetic material including a plurality of flat particles containing a magnetic metal, and a matrix phase disposed around the flat particles and having higher electrical resistance than the flat particles. In a cross-section of the magnetic material, the aspect ratio of the flat particles is 10 or higher. If the major axis of one of the flat particles is designated as L and the length of a straight line connecting two endpoints of the flat particle is designated as W, the proportion of the area surrounded by the outer peripheries of parts in which flat particles satisfying the relationship: $W \leq 0.95 \times L$ are continuously laminated, is 10% or more of the cross-section.

6 Claims, 9 Drawing Sheets

(51) Int. Cl.
*H01F 1/37* (2006.01)
*H01F 27/255* (2006.01)
*H01F 41/02* (2006.01)

(58) Field of Classification Search
USPC ..... 252/62.55, 62.54, 62.51 R, 62.56
See application file for complete search history.

(56) References Cited

U.S. PATENT DOCUMENTS

| | | | | |
|---|---|---|---|---|
| 9,362,033 | B2 * | 6/2016 | Suetsuna | B22F 1/02 |
| 2006/0099454 | A1 * | 5/2006 | Morikoshi | B22F 1/0055 428/692.1 |
| 2007/0001921 | A1 | 1/2007 | Takahashi et al. | |
| 2009/0045905 | A1 | 2/2009 | Nakagawa | |
| 2012/0256118 | A1 | 10/2012 | Nakamura | |
| 2013/0228717 | A1 | 9/2013 | Harada et al. | |

FOREIGN PATENT DOCUMENTS

| | | | | | |
|---|---|---|---|---|---|
| CN | 101297382 | A | | 10/2008 | |
| CN | 102667972 | A | | 9/2012 | |
| JP | 2002-105502 | A | | 4/2002 | |
| JP | 2002105502 | A | * | 4/2002 | H01F 1/24 |
| JP | 2002-289414 | | | 10/2002 | |
| JP | 2002343618 | A | * | 11/2002 | H01F 1/26 |
| JP | 2005-80023 | | | 3/2005 | |
| JP | 2008-69381 | A | | 3/2008 | |
| JP | 2010-242216 | | | 10/2010 | |
| JP | 2013-51329 | | | 3/2013 | |

OTHER PUBLICATIONS

Machine translation of JP2002343618A, printed Jun. 23, 2017, 11 pages.*

* cited by examiner

MAGNETIC MATERIAL AND DEVICE

CROSS-REFERENCE TO RELATED APPLICATION

This application is based upon and claims the benefit of priority from Japanese Patent Application No. 2014-189814, filed on Sep. 18, 2014, the entire contents of which are incorporated herein by reference.

FIELD

Embodiments described herein relate generally to a magnetic material and a device.

BACKGROUND

Development of power inductors is underway in order to mount, for example, power semiconductors in a variety of instruments, and development of a magnetic material having magnetic characteristics such as high magnetic permeability and low magnetic losses in the kilohertz (kHz) range to the megahertz (MHz) range is expected. Furthermore, high saturation magnetization that can withstand a large electric current is expected. If the saturation magnetization is high, it is difficult to saturate magnetization even if a high magnetic field is applied, and an effective decrease in the inductance value can be suppressed. Thus, the direct current superposition characteristics of a device are enhanced, and the efficiency of the system is increased.

Furthermore, a radio wave absorber absorbs the noises generated from electronic instrument by utilizing high magnetic losses, and reduces defects such as malfunction of electronic instrument. Electronic instruments are used in various frequency bands, and high magnetic losses are required in a predetermined frequency band. In general, a magnetic material exhibits high magnetic losses near the ferromagnetic resonance frequency. For example, the ferromagnetic resonance frequency of a magnetic material having low magnetic losses in the MHz range is approximately in the gigahertz (GHz) range. Thus, a magnetic material for MHz-range power inductors is also applicable to, for example, radio wave absorbers that are used in the GHz range.

As such, if a magnetic material having high magnetic permeability and low magnetic losses in the kHz to MHz ranges can be developed, the magnetic material can also be used in devices such as power inductors, antenna apparatuses and radio wave absorbers for high frequency bands of the kHz range or higher.

DETAILED DESCRIPTION (First Embodiment)

The magnetic material of the present embodiment is a magnetic material including: a plurality of flat particles containing a magnetic metal; and a matrix phase disposed around the flat particles and having higher electrical resistance than the flat particles, wherein the aspect ratio of the flat particles is 10 or higher in a cross-section of the magnetic material, and wherein if the major axis of one of the flat particles is designated as L and the length of a straight line connecting two endpoints of the flat particle is designated as W, the proportion of the area surrounded by the outer peripheries of parts in which flat particles satisfying the relationship: $W \leq 0.95 \times L$ are continuously laminated, is 10% or more of the cross-section.

Hereinafter, embodiments of the present invention are explained using the attached drawings.

The inventors found that in regard to a magnetic material, if flat particles containing a magnetic metal are curved and the proportion of those particles is controlled, an increase in the eddy current loss in the particles can be effectively suppressed. As a result, the inventors found that a magnetic material having excellent characteristics such as high saturation magnetization, high magnetic permeability, and low magnetic losses in a high frequency range can be produced easily. The present invention was achieved based on the above findings obtained by the inventors.

Since the magnetic material of the present embodiment includes the configuration described above, the magnetic material realizes high magnetic permeability and low magnetic losses particularly in a high frequency range of 100 kHz or more.

Figure 1:
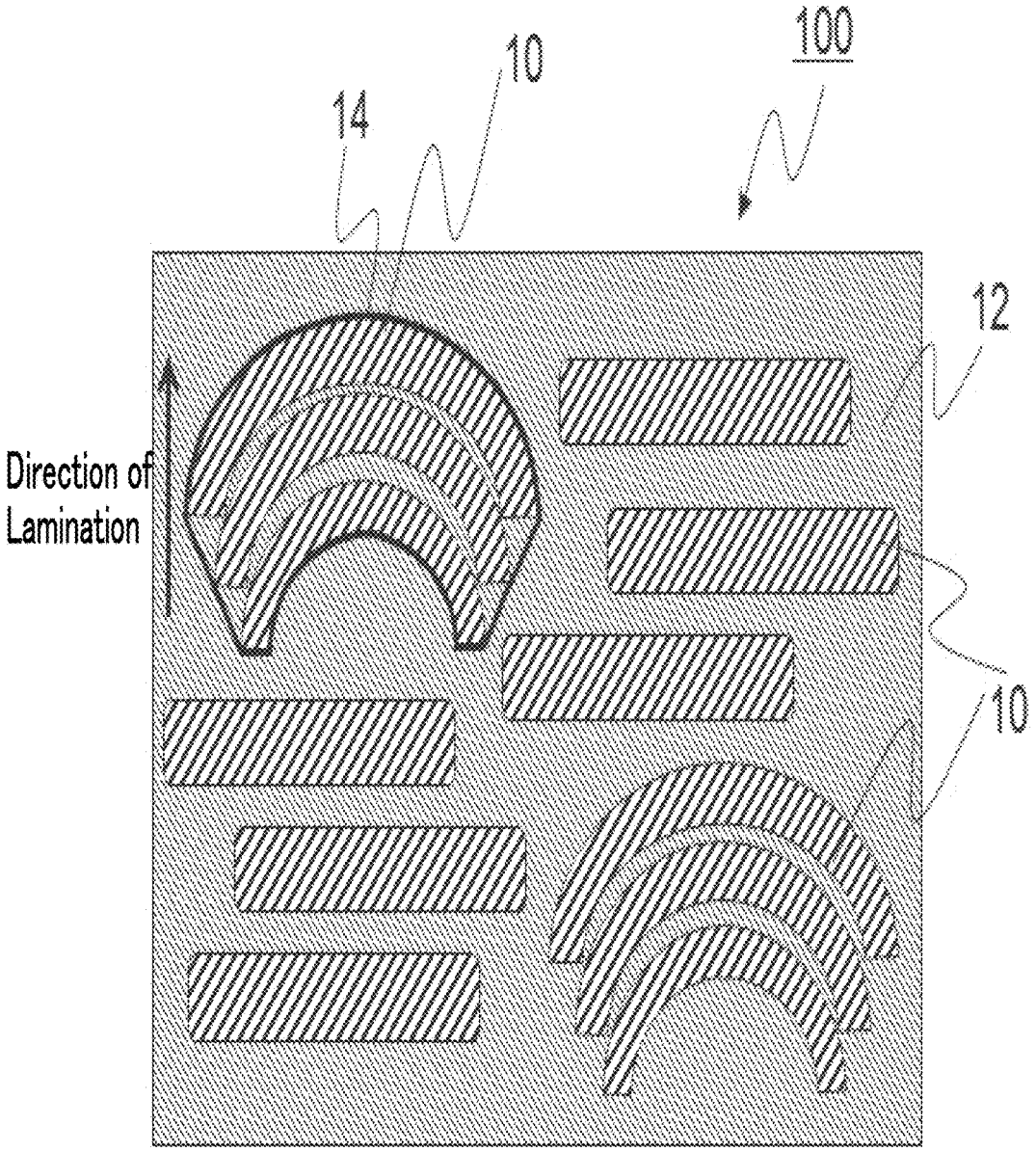
FIG. 1 is a schematic diagram of a magnetic material of a first embodiment.

FIG. 1 is a schematic diagram of a cross-section of the magnetic material of the present embodiment. The magnetic material 100 of the present embodiment includes a plurality of flat particles 10 containing a magnetic metal, and a matrix phase 12.

Flat particles 10 contain a magnetic metal. Here, examples of the magnetic metal include transition metals such as iron (Fe), cobalt (Co) and nickel (Ni); and rare earth metals such as cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), and ytterbium (Yb).

In a cross-section of the magnetic material 100, the aspect ratio of the flat particles 10 is 10 or higher. If the aspect ratio is large an adjustment of the resonance frequency to a high frequency by utilizing shape-induced magnetic anisotropy (magnetization easy axis is aligned in the in-plane direction of the particle, and magnetization hard axis is aligned perpendicular to the plane of the particle), and an increase in the magnetic permeability due to a decrease in the demagnetization factor can be achieved, as compared with the case of a spherical particle. Furthermore, if particles having a large aspect ratio are used, the packing ratio of the magnetic metal can be increased, and the saturation magnetization per unit volume or per unit weight of the magnetic material 100 is increased. Thus, a material with high saturation magnetization and high magnetic permeability is obtained. On the other hand, if the aspect ratio becomes too high, the mechanical strength of the magnetic material 100 is decreased. Thus, the aspect ratio is preferably 500 or less.

Figure 2:
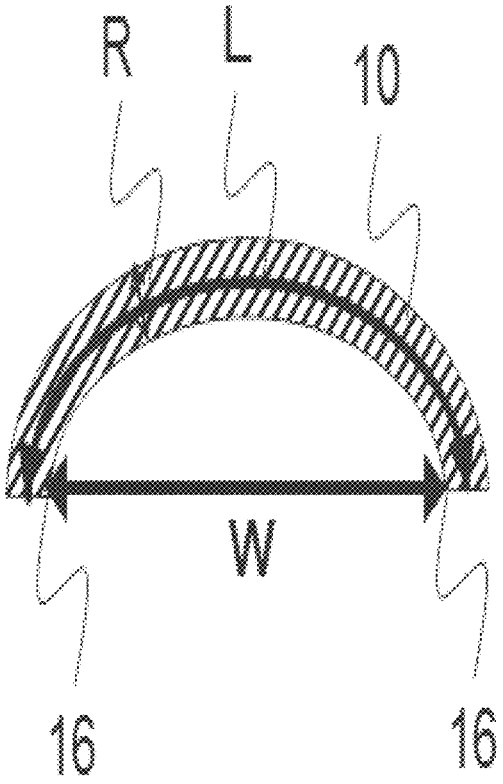
FIG. 2 is a schematic diagram of flat particles of the first embodiment.

When the aspect ratio is determined, for example, the particles are observed using a scanning electron microscope (SEM). A cross-sectional image of the magnetic material 100 is observed at the maximum magnification ratio such that fifty flat particles 10 are included in one image. Among all the flat particles 10 observed in one image, five particles having the largest major axes are selected. The major axis L of each flat particle 10 is defined as the length of a line which passes through the center of the flat particle 10 and extends along to the curved outer circumference of the flat particle 10, as illustrated in FIG. 2. The average value of the major axes of the selected five flat particles 10 is designated as $L_1$. Furthermore, for each of the selected five flat particles 10, the maximum length among the diameters that are perpendicular to the major axis L is designated as the minor axis R, and the average value of the minor axes of the five flat particles 10 is designated as $R_1$. As such, cross-sectional images of the magnetic material 100 are observed in five different viewing fields, and $L_1$, $L_2$, $L_3$, $L_4$, $L_5$, $R_1$, $R_2$, $R_3$, $R_4$, and $R_5$ are measured. Furthermore, the average value of $L_1$ to $L_5$ is designated as La, the average value of $R_1$ to $R_5$ is designated as Ra, and the aspect ratio is defined as La/Ra.

The matrix phase 12 is disposed around the flat particles 10, and the electrical resistance of the matrix phase 12 is higher than that of the flat particles 10. This is because the eddy current loss caused by an eddy current flowing through the entirety of the magnetic material 100 should be suppressed. Examples of the material used in the matrix phase 12 include air, glass, organic resins, oxides, nitrides, and carbides. Examples of the organic resins include an epoxy resin, an imide resin, a vinyl resin, and a silicone resin. Examples of the epoxy resin include resins such as a bisphenol A type epoxy resin, a biphenyl type epoxy resin. Examples of the imide resin include resins such as a polyamideimide resin and a polyamic acid type polyimide resin. Examples of the vinyl resin include resins such as a polyvinyl alcohol resin and a polyvinyl butyral resin. Examples of the silicone resin include resins such as a methylsilicone resin and an alkyd-modified silicone resin. The resistance value of the material of the matrix phase 12 is preferably, for example, 1 mΩ·cm or more.

Whether the electrical resistance of the matrix phase 12 is higher than the electrical resistance of the flat particles 10 can be determined by the measurement of electrical resistance according to a four-terminal method or a two-terminal method, by which the electrical resistance is determined from the electric current and the voltage value between terminals. For example, a method of measuring electrical resistance, by bringing terminals (probes) into contact with a flat particle 10 and a matrix phase 12 respectively, while an electronic image of a sample of the flat particles 10 and the matrix phase 12 mixed together is observed with a SEM (scanning electron microscope), is available. Also, the electrical resistance of the matrix phase 12 can be evaluated by this method.

In a cross-section of the magnetic material 100, if the major axis of one of the flat particles is designated as L and the length of a straight line connecting two endpoints of the flat particle is designated as W, the proportion of the area surrounded by the outer peripheries of parts in which flat particles satisfying the relationship: $W \leq 0.95 \times L$ are continuously laminated, is 10% or more of the cross-section. An endpoint is defined as an end of the inner arc of a curved flat particle, as illustrated in FIG. 2. The length W of a straight line connecting two endpoints 16 is observed using, for example, SEM. A cross-sectional image of the magnetic material 100 is observed such that the length of one side of the image be adjusted to 8 to 12 times the length of the major axis La calculated as described above. In one image the area surrounded by the outer peripheries of parts in which flat particles satisfying the relationship $W \leq 0.95 \times L$ are continuously laminated, is calculated. In a case in which two or more flat particles 10 satisfying the relationship: $W \leq 0.95 \times L$ are laminated, with the matrix phase 12 or a non-magnetic phase other than the matrix phase 12 being interposed between the flat particles, the part is regarded as the part in which flat particles 10 satisfying the relationship: $W \leq 0.95 \times L$ are continuously laminated. Furthermore, if flat particles 10 satisfying the relationship: $W \leq 0.95 \times L$ overlap even partially in the direction of lamination, the part is regarded as the part in which flat particles 10 satisfying the relationship: $W \leq 0.95 \times L$ are continuously laminated. In this laminated part, if a flat particle which satisfies $L \geq W > 0.95 \times L$ exists between the flat particles, the part is not regarded as the part in which flat particles satisfying the relationship: $W \leq 0.95 \times L$ are continuously laminated.

An example of the surrounding (outer periphery) of the part in which flat particles satisfying the relationship: $W \leq 0.95 \times L$ are continuously laminated, is shown in the curve 14 of FIG. 1. It is preferable that the proportion of the area S of the part surrounded as such is 10% or more of the area of the cross-section of the magnetic material 100.

FIGS. 3A to 3D present diagrams of the surrounded part in which flat particles satisfying the relationship: $W \leq 0.95 \times L$ are continuously laminated. Hereinafter, the method for surrounding (drawing an outer periphery) is specifically described. First, in a SEM image of a cross-section of the magnetic material 100 observed such that the length of one side of the image is adjusted to 8 to 12 times the length of the major axis La, one flat particle (1) satisfying the relationship: $W \leq 0.95 \times L$ is selected. In a case in which a flat particle (2) that is adjacent in the direction of lamination of the flat particle (1) satisfies the relationship: $W \leq 0.95 \times L$, and only a matrix phase or a non-magnetic phase exists between the flat particles (1) and (2), the part is regarded as the part in which the flat particles (1) and (2) are continuously laminated. Similarly, in a case in which a flat particle (3) that is adjacent in the direction of lamination of the flat particle (2) satisfies the relationship: $W \leq 0.95 \times L$, and only the matrix phase or the non-magnetic phase exists between the flat particles (2) and (3), the part is regarded as the part in which the flat particles (1), (2) and (3) are continuously laminated. As such, a part in which two or more curved flat particles satisfying the relationship: $W \leq 0.95 \times L$ are continuously laminated is identified. Meanwhile, in FIGS. 3A to 3D, reference numerals (1), (2) and (3) representing the respective flat particles are not shown in the diagrams because the flat particles are not specifically identified.

Figure 3A:
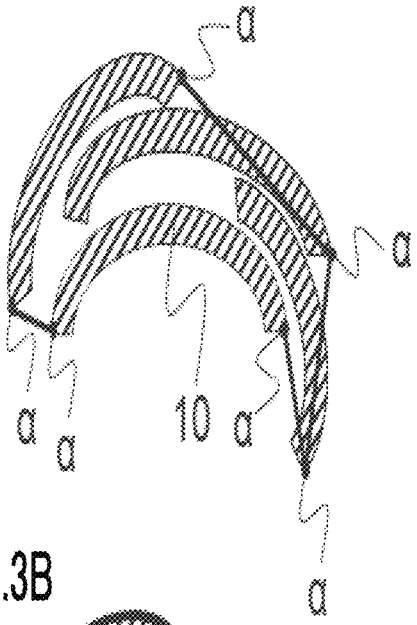
FIGS. 3A to 3D are schematic diagrams of flat particles of the first embodiment.
Figure 3C:
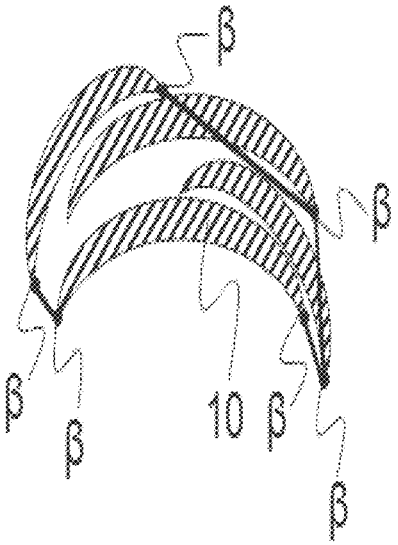
Figure 3B:
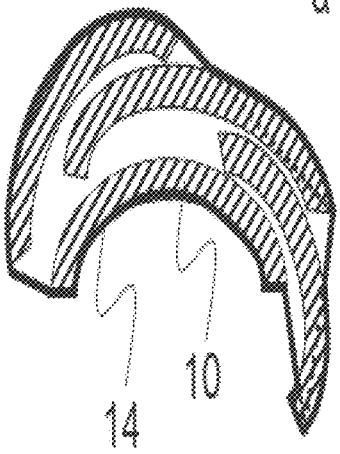

FIGS. 3A and 3B are diagrams illustrating that the flat particles 10 have a shape formed by an outer arc, an inner arc and straight lines, and four flat particles satisfying the relationship: $W \leq 0.95 \times L$ are laminated. First, as shown in FIG. 3A, among the vertices of the outer arcs of the four flat particles, plural vertices α present on the outermost side are identified (six solid circles in FIG. 3A). Subsequently, the vertices α of adjacent flat particles are connected by straight lines. The vertices α present within a same flat particle are not connected. The outer periphery is surrounded with solid lines by connecting the straight lines drawn in FIG. 3A and the edges (arcs and straight lines) of the flat particles (FIG. 3B).

Figure 3D:
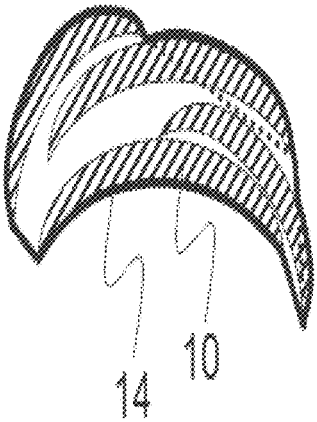

FIGS. 3C and 3D are diagrams illustrating that flat particles 10 have a shape formed by an outer arc and an inner arc, and four flat particles satisfying the relationship: $W \leq 0.95 \times L$ are laminated. First, as shown in FIG. 3C, among the vertices of the four flat particles, plural vertices β present on the outermost side are identified (six solid circles in FIG. 3C). Subsequently, the vertices β of adjacent flat particles are connected by straight lines. The vertices β present within a same flat particle are not connected. The outer periphery is surrounded with solid lines by connecting the straight lines drawn in FIG. 3C and the arcs of the flat particles (FIG. 3D).

As such, in a SEM image of a cross-section of the magnetic material 100 observed such that the length of one side of the image is adjusted to 8 to 12 times the length of the major axis La, parts in which two or more flat particles satisfying the relationship: $W \leq 0.95 \times L$ are continuously laminated are all identified, the outer periphery is surrounded as illustrated in FIG. 3B and FIG. 3D, and the proportion of the sum of area S of the surrounded parts with respect to the cross-sectional area of the magnetic material 100 is calculated.

Figure 4A:
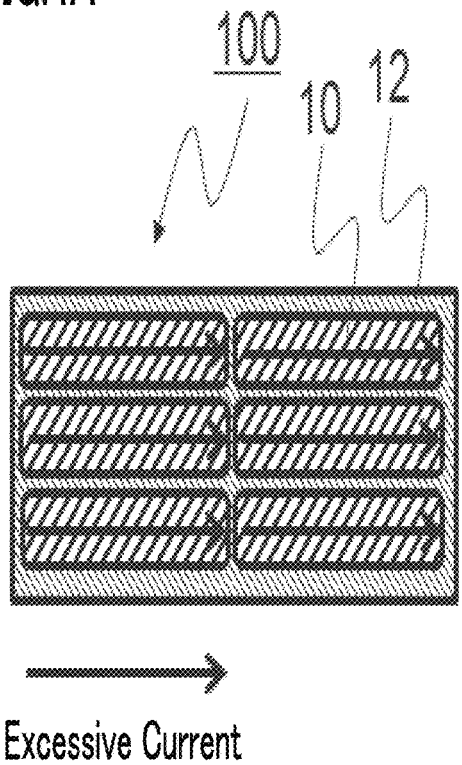
FIGS. 4A and 4B are schematic diagrams of the magnetic material of the first embodiment.
Figure 4B:
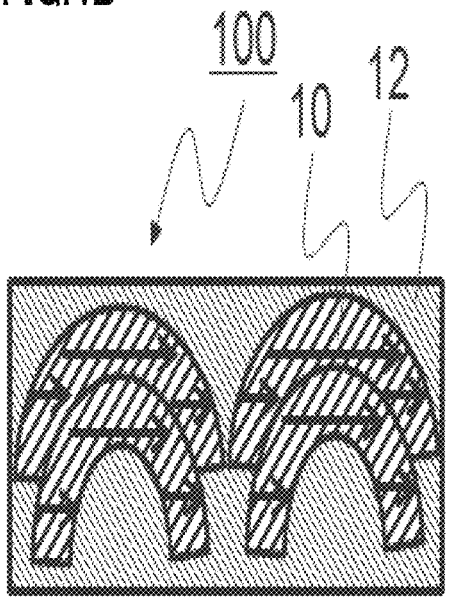

As shown in FIGS. 4A and 4B, if a flat particle 10 satisfies the relationship: $W \leq 0.95 \times L$, the linear distance of an eddy current flowing through the flat particle 10 is shortened, and the eddy current loss can be decreased. If the major axis L of the flat particle 10 is made larger, the eddy current loss is increased in a high frequency range; however, as the flat particle 10 is bent as such, even a flat particle 10 having a large major axis L can also be used. Furthermore, if a flat particle 10 having a large major axis L is used, it is advantageous in that oxidation of the flat particle 10 is suppressed, the packing ratio of the flat particles 10 is increased, and the saturation magnetization is increased.

The proportion of the area S calculated as described above is 10% or more of the area of a cross-section of the magnetic material 100 (area of the SEM image of a cross-section of the magnetic material 100). If the proportion of the area S is smaller than 10%, the effect of decreasing the eddy current loss may not be obtained. Furthermore, if the area S is 10% or more, the strength of the magnetic material 100 in a direction perpendicular to the direction of lamination of the flat particles 10 can be increased.

The average value La of the major axes of the flat particles is preferably from 1 μm to 50 μm. In general, the eddy current loss is directly proportional to the square of the frequency, and the eddy current loss is increased in a high frequency range. If the average value La of the major axes of the flat particles 10 is larger than 50 μm, the eddy current loss generated within the particles becomes markedly large at approximately 100 kHz or higher, which is not preferable. Furthermore, the ferromagnetic resonance frequency is decreased, and a loss caused by ferromagnetic resonance is manifested in the MHz range, which is not preferable. If the average value La of the major axes of the flat particles 10 is smaller than 1 μm, the eddy current loss in a high frequency range is small; however, the coercive force becomes large, and the hysteresis loss is increased, which is not preferable. As such, in order to realize a magnetic material 100 having low magnetic losses in the 100 kHz range to the MHz range, the major axes of the flat particles 10 should be in an adequate range.

It is preferable that the flat particles 10 contain iron (Fe), cobalt (Co) or nickel (Ni). The flat particles 10 may be formed of a simple metal of Fe, Co or Ni. The flat particles 10 may be formed from an alloy such as an Fe-based alloy, a Co-based alloy, an FeCo-based alloy, or an FeNi-based alloy. Examples of the Fe-based alloy include an FeCo alloy, an FeNi alloy, an FeMn (iron-manganese) alloy), and an FeCu (iron-copper) alloy. Examples of the Co-based alloy include a CoFe alloy, a CoNi alloy, a CoMn alloy, and a CoCu alloy. Examples of the FeCo-based alloy include an FeCoNi alloy, an FeCoMn alloy, and an FeCoCu alloy. Examples of the FeNi-based alloy include an FeNiMn alloy, an FeNiCu alloy, and an FeNiAl alloy. Meanwhile, in the flat particles 10, an oxide film covering the flat particles 10 may be formed on the surface.

It is preferable that the flat particles 10 contain an iron oxide, a cobalt oxide, or a nickel oxide. If the flat particles 10 contain an oxide in the interior, oxidation of the magnetic metal (Fe, Co or Ni) caused by diffusion of oxygen into the flat particles 10 can be suppressed. As a result, a magnetic material 100 having high saturation magnetization, less deterioration over time caused by oxidation, and high reliability is realized. Here, the iron oxide is, for example, an oxide represented by the chemical formula: $FeO_x$, in which $1 \leq x \leq 1.5$. Furthermore, the cobalt oxide is, for example, an oxide represented by the chemical formula: $CoO_y$, in which $1 \leq y \leq 4/3$. Furthermore, the nickel oxide is, for example, an oxide represented by the chemical formula: $NiO_z$, in which $1 \leq z \leq 2$.

A composition analysis of the elements used in the present embodiment can be carried out by, for example, scanning electron microscopy-energy dispersive X-ray fluorescence spectrometry (SEM-EDX) or transmission electron microscopy-energy dispersive X-ray fluorescence spectrometry (TEM-EDX).

Figure 5:
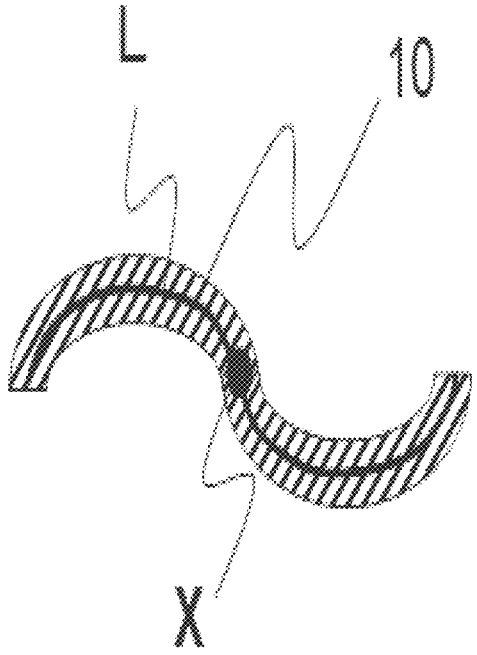
FIG. 5 is a schematic diagram of the flat particles of the first embodiment.

It is preferable that the major axis L of a flat particle 10 has an inflection point. The inflection point is a point at which the major axis L changes from upward convexity to downward convexity (point X in FIG. 5), that is, a point at which the gradient of the tangent line of the major axis L changes from a monotonic increase to a monotonic decrease. If the major axis L of a flat particle 10 has an inflection point as shown in FIG. 5, there is an effect of further suppressing the eddy current loss or an effect of increasing the strength in a direction perpendicular to the direction of lamination of the particles, as compared with a flat particle having no inflection point as shown in FIG. 2.

Thus, according to the magnetic material of the present embodiment, a magnetic material having characteristics such as high magnetic permeability and low magnetic losses in a high frequency range can be provided.

(Second Embodiment)

The device of the present embodiment is a device including the magnetic material 100 described in the above embodiment. Therefore, regarding the matters overlapping with the matters of the above-described embodiment, further description will not be repeated here.

Examples of the device of the present embodiment include high frequency magnetic component parts such as an inductor, a choke coil, a filter, and a transformer; antenna substrates and component parts, and radio wave absorbers.

An application which can best utilize the features of the magnetic material 100 of the embodiment described above is an inductor. Particularly, if the magnetic material is applied to a power inductor to which a high electric current is applied in a high frequency range of 100 kHz or higher, the effects of high magnetic permeability and low magnetic losses carried by the magnetic material 100 may be easily exerted.

FIGS. 6A and 6B, FIGS. 7A and 7B, and FIG. 8 are exemplary conceptual diagrams of the inductor of the present embodiment.

Figure 6A:
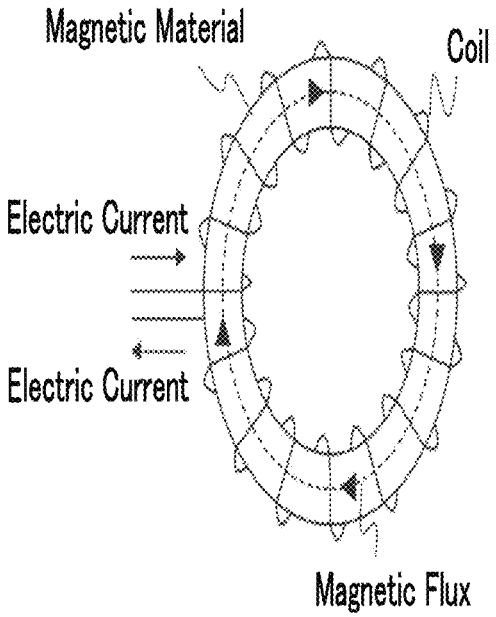
FIGS. 6A and 6B are conceptual diagrams of a device of a second embodiment.
Figure 6B:
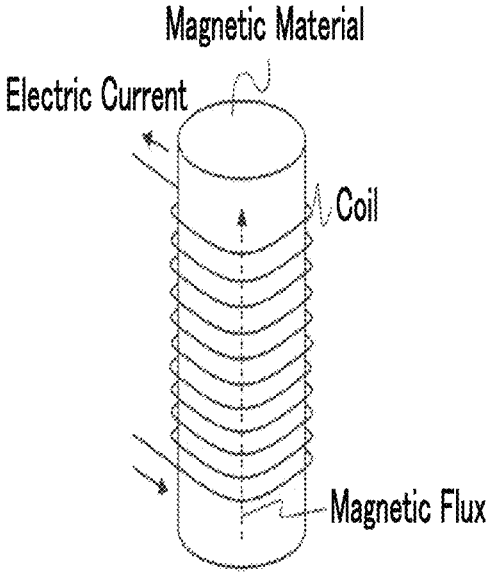

The most fundamental structure may be a form in which a ring-shaped magnetic material is provided with a coil wound around the material as shown in FIG. 6A, or a form in which a rod-shaped magnetic material is provided with a coil wound around the material as shown in FIG. 6B. In order to integrate the flat particles 10 and the matrix phase 12 into a ring shape or a rod shape, it is preferable to press mold the materials at a pressure of 0.1 $kgf/cm^2$ or more. If the pressure is smaller than 0.1 $kgf/cm^2$, more pores are generated inside the molded body, the volume ratio of the flat particles 10 is decreased, and there is a risk that the saturation magnetization and the magnetic permeability may be decreased. Examples of the press molding include techniques such as a uniaxial press molding method, a hot press molding method, a cold isostatic pressing (CIP) (isotropic pressure molding) method, a hot isostatic pressing (HIP) (hot isotropic pressure molding) method, and a spark plasma sintering (SPS) method.

Figure 7A:
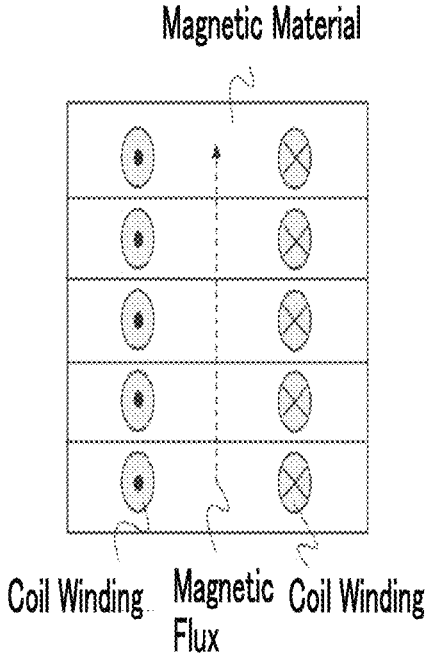
FIGS. 7A and 7B are conceptual diagrams of the device of the second embodiment.
Figure 7B:
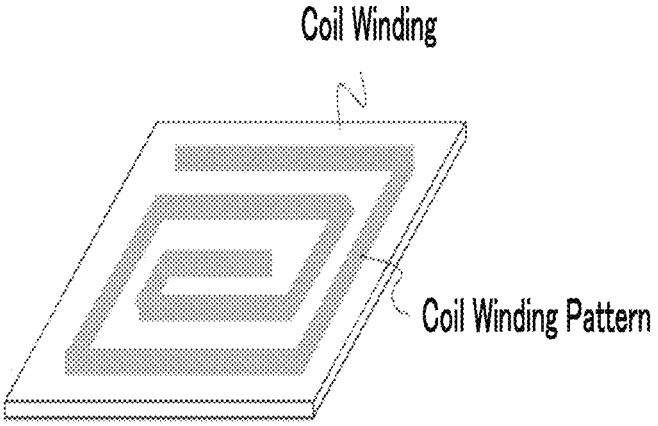

Furthermore, a chip inductor in which the wound coil and the magnetic material are integrated as shown in FIG. 7A, or a planar inductor shown in FIG. 7B may be employed. The chip inductor may also be formed into a laminate type as shown in FIG. 7A.

Figure 8:
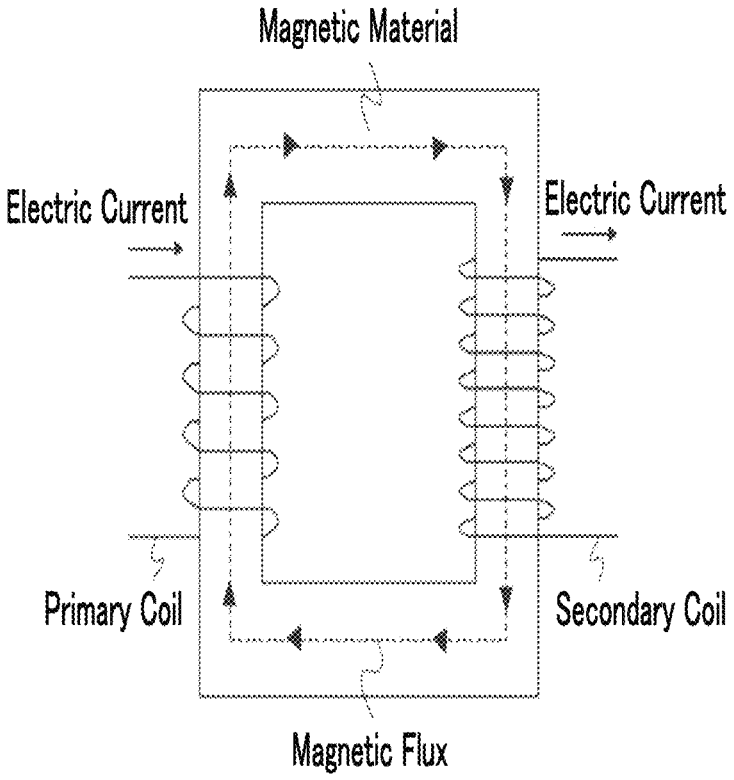
FIG. 8 is a conceptual diagram of the device of the second embodiment.

FIG. 8 illustrates an inductor having a transformer structure.

FIGS. 6A and 6B, FIGS. 7A and 7B, and FIG. 8 merely show representative structures, and in fact, it is preferable to change the structure or the dimension according to the use and the required inductor characteristics.

According to the device of the present embodiment, a device having excellent characteristics such as high magnetic permeability and low magnetic losses particularly in a high frequency range of 100 kHz or higher can be realized.

EXAMPLES

Hereinafter, Examples will be explained.

Example 1

Fe particles having a particle size of 4 μm and acetone were introduced into a planetary mill that used a $ZrO_2$ vessel and $ZrO_2$ balls, and the mixture was subjected to milling processing at 500 rpm for 1 hour in an Ar atmosphere. Thus, flat particles having an average value La of the major axis of 9 μm, an average value Ra of the minor axis of 450 nm, and an aspect ratio of 20 were obtained. These flat particles and a vinyl resin were mixed at a weight ratio of 100:2, and a ring-shaped evaluation sample was produced by press molding. A cross-section of this sample was observed with a scanning electron microscope (SEM), and the proportion of the area S surrounded by the outer peripheries of parts in which flat particles satisfying the relationship: $W \leq 0.95 \times L$ were continuously laminated, was 11%.

For this evaluation sample, the magnitude of magnetization with respect to the applied magnetic field was measured using a vibrating sample magnetometer (VSM), and the saturation magnetization was 1.37 T.

A copper wire was wound 40 times around this evaluation sample, and the relative permeability and the magnetic loss (core loss) at 1 MHz and 10 mT were measured using B-H Analyzer SY-8232 manufactured by Iwatsu Test Instruments Corp. The relative permeability was 27.5, and the magnetic loss was 290 $kW/m^3$. The above results are presented in Table 1.

Example 2

Production and measurement of an evaluation sample were carried out in the same manner as in Example 1, except that the milling processing time was changed to 30 minutes. The results are presented in Table 1.

Comparative Example 1

Production and measurement of an evaluation sample were carried out in the same manner as in Example 1, except that Fe particles having a particle size of 3 μm were used, and the milling processing time was changed to 30 minutes. The results are presented in Table 1.

Comparative Example 2

Production and measurement of an evaluation sample were carried out in the same manner as in Example 1, except that Fe particles having an average value La of the major axes of 50 μm and an average value Ra of the minor axes of 5 μm were mixed with a vinyl resin, without milling processing the Fe particles. The results are presented in Table 1.

Example 3

Production and measurement of an evaluation sample were carried out in the same manner as in Example 1, except that Fe particles having a particle size of 100 nm were used, and the particles were subjected to milling processing at 700 rpm for 10 minutes. The results are presented in Table 1.

Example 4

Production and measurement of an evaluation sample were carried out in the same manner as in Example 1, except that the milling processing time was changed to 3 hours. The results are presented in Table 1.

Example 5

Production and measurement of an evaluation sample were carried out in the same manner as in Example 1, except that Fe particles having a particle size of 100 nm were used, and the particles were subjected to milling processing at 200 rpm for 30 minutes. The results are presented in Table 1.

Example 6

Production and measurement of an evaluation sample were carried out in the same manner as in Example 1, except that Fe particles having an average value La of the major axes of 108 μm and an average value Ra of the minor axes of 10 μm were mixed with a vinyl resin, without milling processing the Fe particles. The results are presented in Table 1.

Example 7

Production and measurement of an evaluation sample were carried out in the same manner as in Example 1, except that Co particles having a particle size of 4 μm were used. The results are presented in Table 1.

Example 8

Production and measurement of an evaluation sample were carried out in the same manner as in Example 1, except that Ni particles having a particle size of 4 μm were used. The results are presented in Table 1.

Example 9

An evaluation sample was produced in the same manner as in Example 1, except that milling processing was carried out in air. These flat particles contained $Fe_2O_3$ in the particles. The results of performing the measurement in the same manner as in Example 1 are presented in Table 1.

Example 10

An evaluation sample was produced in the same manner as in Example 7, except that milling processing was carried out in air. These flat particles contained $Co_3O_4$ in the particles. The results of performing the measurement in the same manner as in Example 1 are presented in Table 1.

Example 11

An evaluation sample was produced in the same manner as in Example 8, except that milling processing was carried out in air. These flat particles contained NiO in the particles. The results of performing the measurement in the same manner as in Example 1 are presented in Table 1.

Example 12

Figure 9:
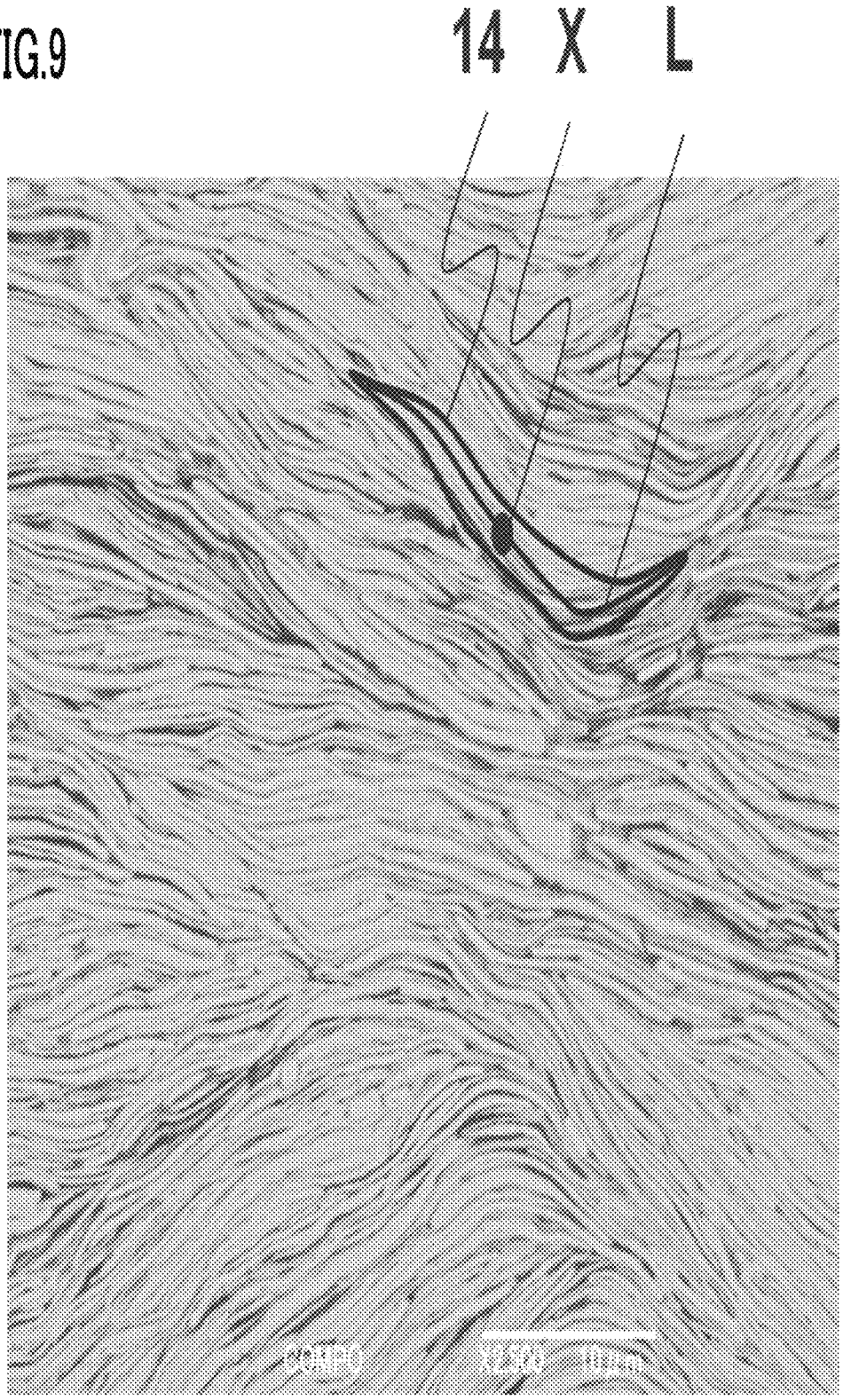
FIG. 9 is an observation image of a cross-section of the magnetic material of Example 12.

An evaluation sample was produced in the same manner as in Example 1, except that the milling processing time was changed to 1.5 hours. The results of performing the measurement in the same manner as in Example 1 are presented in Table 1. FIG. 9 is an observation image of a cross-section of the magnetic material of Example 12. An example of the outer periphery 14 of a part in which flat particles satisfying the relationship: W≤0.95×L are continuously laminated, and the inflection point X of the major axis L are shown.

TABLE 1

| | La [μm] | La/Ra | Proportion of area S | Saturation magneti-zation[T] | Relative perme-ability | Magnetic loss [kW/m³] |
|---|---|---|---|---|---|---|
| Example 1 | 9 | 20 | 11 | 1.37 | 27.6 | 275 |
| Example 2 | 5 | 10 | 10 | 1.37 | 26.2 | 284 |
| Comparative Example 1 | 4 | 8 | 10 | 1.20 | 17.1 | 299 |
| Comparative Example 2 | 50 | 10 | 2 | 1.66 | 47.5 | 456 |
| Example 3 | 1 | 20 | 15 | 1.30 | 21.2 | 285 |
| Example 4 | 50 | 25 | 14 | 1.68 | 49.1 | 277 |
| Example 5 | 0.5 | 10 | 10 | 1.20 | 21.0 | 303 |
| Example 6 | 108 | 11 | 11 | 1.69 | 45.2 | 309 |
| Example 7 | 9 | 18 | 10 | 1.14 | 23.1 | 288 |
| Example 8 | 9 | 20 | 11 | 0.39 | 14.0 | 289 |
| Example 9 | 9 | 20 | 11 | 1.35 | 26.7 | 270 |
| Example 10 | 9 | 18 | 10 | 1.11 | 13.3 | 281 |
| Example 11 | 9 | 20 | 11 | 0.37 | 13.5 | 283 |
| Example 12 | 10 | 40 | 15 | 1.39 | 28.5 | 266 |

The magnetic materials 100 of Examples 1 to 12 are such that the aspect ratio La/Ra of flat particles 10 is 10 or higher, and if the major axis of one of the flat particles is designated as L, and the length of a straight line connecting two endpoints of the flat particle is designated as W, the proportion of the area S surrounded by the outer peripheries of parts in which flat particles satisfying the relationship: W≤0.95×L are continuously laminated, is 10% or more. As is obvious from Table 1, the saturation magnetization and the specific magnetic permeability are larger, or the magnetic loss at 1 MHz is smaller, as compared with Comparative Example 1 having an aspect ratio of less than 10. Furthermore, the magnetic loss at 1 MHz is smaller compared with Comparative Example 2 having a proportion of the area S of less than 10%. From the above results, it is understood that the magnetic material 100 of the present invention has excellent magnetic characteristics such as high saturation magnetization, high magnetic permeability, and low magnetic losses in a high frequency range.

Furthermore, Examples 1 to 4 and 7 to 12, in which the average value La of the major axes of the flat particles 10 is from 1 μm to 50 μm, have lower magnetic losses at 1 MHz compared with Examples 5 and 6, in which the average value La is not in this range.

Furthermore, Examples 9 to 11 containing an iron oxide $Fe_2O_3$, a cobalt oxide $Co_3O_4$, or a nickel oxide NiO, in the interior of the flat particles 10 have lower magnetic losses at 1 MHz compared with Examples 1, 7 and 8 that do not contain these oxides.

Furthermore, Example 10 in which the major axes L of the flat particles 10 have inflection points, has a lower magnetic loss at 1 MHz compared with Examples 1 to 9 and 11 that do not have inflection points.

Particularly, Examples 1, 2, 4, 9 and 12 have excellent magnetic characteristics such as high saturation magnetization, high magnetic permeability, and low magnetic losses in a high frequency range.

While certain embodiments have been described, these embodiments have been presented by way of example only, and are not intended to limit the scope of the inventions. Indeed, the magnetic material and the device described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A magnetic material comprising:

a plurality of particles comprising a magnetic metal; and a matrix phase disposed around the particles and having a higher electrical resistance than the particles;

wherein:

an aspect ratio of the particles is 10 or higher in a cross-section of the magnetic material;

the cross-section of the magnetic material has a total area, and a proportion of the total area defined by outer peripheries of continuously laminated particles is 10% or more;

in the cross-section of the magnetic material, the continuously laminated particles are curved to satisfy W≤0.95×L, where L is a major axis of a particle, and W is a length of a straight line connecting two endpoints of the particle, the continuously laminated particles are curved in the same direction, and the matrix phase is interposed between the continuously laminated particles.

2. The magnetic material according to claim 1, wherein an average value of the major axes L of the particles is from 1 μm to 50 μm.

3. The magnetic material according to claim 1, wherein the particles comprise iron, cobalt, or nickel.

4. The magnetic material according to claim 1, wherein the particles comprise an iron oxide, a cobalt oxide, or a nickel oxide.

5. The magnetic material according to claim 1, wherein the major axis L of one of the particles has an inflection point.

6. A device comprising the magnetic material according to claim 1.

* * * * *